United States Patent [19]

Mateson

[11] Patent Number: 4,801,312

[45] Date of Patent: Jan. 31, 1989

[54] LAMINAR AIR FLOW HAZARDOUS MATERIALS ABATEMENT METHOD AND SYSTEM

[76] Inventor: Mark E. Mateson, 905 Berkeley Rd., Wilmington, Del. 19807

[21] Appl. No.: 155,039

[22] Filed: Feb. 11, 1988

[51] Int. Cl.[4] ..... B01D 46/00

[52] U.S. Cl. ..... 55/97; 55/473; 55/385.2; 98/33.1; 98/36; 98/42.02

[58] Field of Search ..... 55/97, 385 A, 467, 473, 55/DIG. 29; 98/36, 31.5, 32, 33.1, 39.1, 40.01, 40.05, 40.1, 40.19, 42.01, 42.02

[56] References Cited

U.S. PATENT DOCUMENTS

| | | | |
|---|---|---|---|
| 3,294,480 | 12/1966 | Patapenko | 98/33.1 |
| 4,604,111 | 8/1986 | Natale | 55/97 |
| 4,693,173 | 9/1987 | Saiki et al. | 98/42.02 |

OTHER PUBLICATIONS

U.S. Statutory Invention Registration, Reg. No. H460 published 4/5/88, filed 9/24/87.

*Primary Examiner*—Bernard Nozick
*Attorney, Agent, or Firm*—Ratner & Prestia

[57] ABSTRACT

A work space for removing hazardous materials within an occupied building is made safe both for the workers working within the work space and others outside the work space by defining a decontamination space having a plurality of rooms and air locks between the rooms and a work space opening on the decontamination space, supplying fresh air to the work space through a duct in the wall of the work space, supplying fresh air to each of the rooms and air locks and evacuating air from each of the rooms and the air locks and forcing the evacuated air through the same work space wall to provide a substantially laminar air flow from the wall. A row of air filtration devices normal to the air flow filters the air flow and expels the air in the same direction away from the wall. A second row of air filtration devices receives the previously filtered air, further filters it, and expels it into a duct leading to the outside of the building. The air pressure within the work space and the decontamination space may be independently controlled.

21 Claims, 2 Drawing Sheets

LAMINAR AIR FLOW HAZARDOUS MATERIALS ABATEMENT METHOD AND SYSTEM

TECHNICAL FIELD

The present invention relates to hazardous materials contamination control and in particular to a laminar air flow method and system for rendering a work space safe for workers engaged in removing toxic particulates from interior surfaces of buildings.

BACKGROUND OF THE INVENTION

Serious health risks confront individuals working in a space subject to contamination with hazardous materials. A particularly dangerous space is one in which asbestos coatings are removed from surfaces inside a building. When these coatings are removed, fibers are released into the air and it is well established that these fibers pose a significant health risk. The coatings may be wetted down before removal to minimize the amount of fiber released into the air. However, enough fibers are still released to pose significant health risks.

It is known in the art to enclose an asbestos removal area to contain the released fibers. These enclosures may be formed of plastic sheets with as few seams as possible in order to prevent airborne asbestos fibers from spreading to other areas of the building. However, the air within the enclosures must eventually be exhausted and particulate matter in the exhausted air may become a health risk for persons in the building or, if it is exhausted outdoors, for those outside the building.

Thus it is known to provide free standing air filtration devices within the enclosure to remove particulate matter. For example, the air filtration devices may be arranged to blow air in a circular pattern around the inside of the enclosure. It is also known to direct the output of the air filtration devices directly on the workers within the enclosure to surround them with filtered air. However, this arrangement results in some areas of the enclosure being provided with higher air flow than other areas and allows particulate matter to collect in certain areas. Additionally, decontamination rooms, coupled to the work space, are commonly used. These rooms provide areas for the workers to store equipment, shower and change their clothing. Air flow is normally provided through the decontamination rooms to control the spread of particulate matter from the work space. Nevertheless, it has been determined that the particulate matter collects in the corners on the floors of these rooms.

U.S. Pat. No. 4,604,111 issued to Natale shows an enclosure around a source of hazardous particulate matter along with a decontamination chamber space. Air flow is provided through the enclosure and through the decontamination chamber. This air is then filtered and exhausted. However, the air inlet and outlet of the decontamination chamber are positioned such that an uneven or non-uniform pattern of air flow through the decontamination chamber and through the decontaminated areas may result before the air is exhausted. Thus the system of Natale still permits particulate matter to build up in the corners and thereby to form a health hazard.

When hazardous materials are removed in an occupied area, the concentration of particles around the enclosure is monitored at all times. It has been shown that in the systems of the prior art there are peaks of concentration at different points around the enclosure during removal of the toxic particulate. These peaks may exceed safe levels.

SUMMARY OF THE INVENTION

It has now been found that the hazards involved in either the dry or wet removal of toxic particulates such as asbestos may be eliminated or safely controlled by a method and system which will reduce the fiber concentration in a work space to 0.01 fibers or less per cubic centimeter, including fibers as small as 0.1 microns in diameter and 2 microns in length as measured by a scanning electron microscope (SEM) with a 6,000 to 10,000 magnification.

The system of the invention includes a decontamination space having a plurality of enclosed decontamination rooms and air locks between the rooms and a work space communicating with the decontamination space. A fresh air duct through a wall of the work space supplies fresh air to the work space. Fresh air is also supplied to each of the decontamination rooms and to air locks through at least two inlet ducts which run the entire length of the decontamination space. Air is evacuated from each of the rooms and air locks through outlet ducts in the decontamination space and the evacuated air is forced into the work area. The evacuated air from the decontamination space and the fresh air from the fresh air ducts act cooperatively to form a substantially uniform air flow in the work space. A first row of spaced apart air filtration devices receives this uniform air flow, filters the air and expels it toward a second row of air filtration devices. The second row of air filtration devices filters the air further and expels the filtered air into a duct which exits from the work space, thus exhausting the filtered air.

The present invention accordingly not only protects workers in the bulding but also prevents the outside environment from being contaminated by a variety of hazardous particulates.

DETAILED DESCRIPTION OF THE INVENTION

Figure 1:
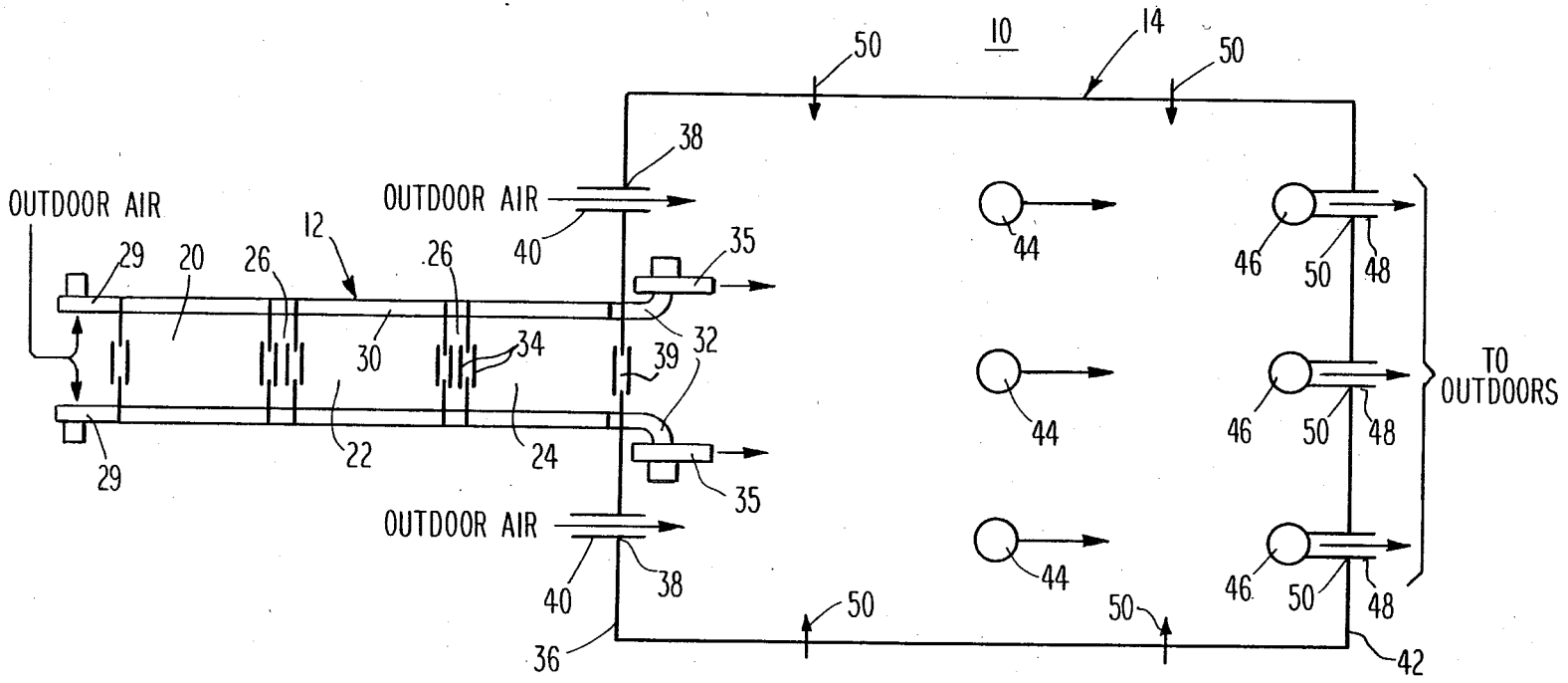
FIG. 1 is a schematic top plan view of the system of the present invention.
Figure 2:
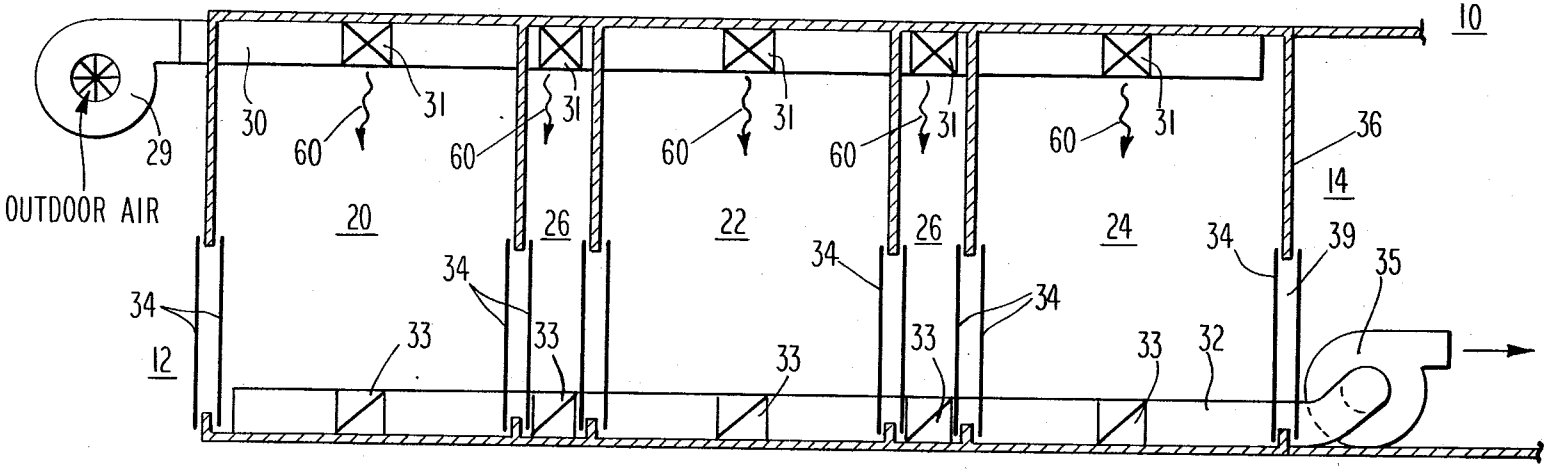
FIG. 2 is an enlarged, a verticl cross-sectional view, partially schematic, of the decontamination space of the system of FIG. 1.
Figure 3:
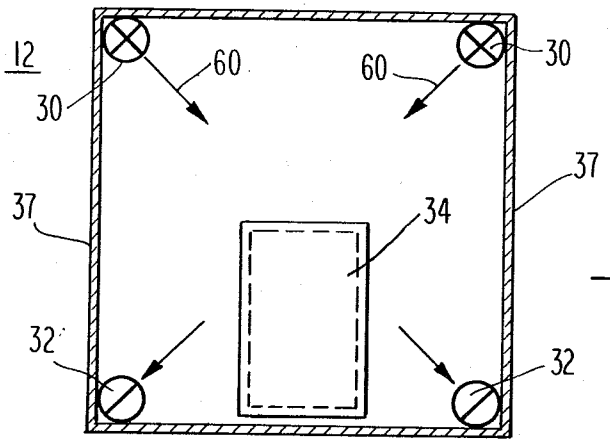
FIG. 3 is a vertical frontal view of the decontamination space of the system of FIG. 1.

Referring to FIGS. 1, 2 and 3, there is shown a laminar air flow asbestos abatement system 10 of the present invention. System 10 comprises decontamination space 12 and work space 14. Decontamination space 12 includes a clean room 20, a shower room 22, and an equipment room 24 as well as air locks 26 between rooms 20,22 and between rooms 22,24. Work space 14 is an enclosure adapted to define a region in which hazardous materials, particularly asbestos coatings, may be safely removed, and is provided with opening 39 to permit passage between decontamination space 12 and work space 14.

For the purpose of the present invention and except where the content indicates otherwise, the walls of decontamination space 12 and work space 14 mean and include ceilings and floors and existing walls as well as temporarily or artificially provided walls. Thus, decontamination space 12 and work space 14 may be formed using existing enclosures or may partially use existing walls while providing additional walls using, for example, plastic sheets. However, if any existing walls are used, they are covered with plastic sheets. Suitable plastic sheets comprise 6 mil polyethylene. Two layers are preferred for the walls of work space 12 while additional layers are preferred for areas which will be walked upon.

Every wall in decontamination space 12 between rooms 20, 22, 24 and adjoining air locks 26 has a sealable opening such as a doorway. Additionally, a sealable opening is provided to close off opening 39 between room 24 of decontamination space 12 and work space 14. The sealable openings may be flap-seal doorways in which sheets of plastic film such as polyethylene form flap seal doors 34 on each side of the openings to cover and seal the openings. In response to air pressure, flaps 34 of the flap-seal doorways fall into place and prevent air from escaping from regions of higher pressure to regions of lower pressure while permitting people to pass through by moving flaps 34. Thus each sealable opening of system 10 may be closed by a flap 34 regardless which side of the opening is at a higher pressure because one flap 34 over the opening is forced closed while the other flap 34 is not.

Flap-seal doorways may be contructed permanently or may be provided around existing doorways. Air locks 26, approximatlly three feet in length, permit one flap 34 to be completely closed before opening another flap 34 while also enabling passage from one room 20, 22, 24 to another within decontamination space 12.

Fresh air from the external environment is supplied to decontamination space 12 by way of two decontamination space inlet ducts 30. As shown in FIG. 2, decontamination space inlet ducts 30 are positioned at the top of decontamination space 12 against opposing vertical side walls 37 and provide fresh air flow into every room 20, 22, 24 and into every air lock 26 of decontamination space 12 by way of diffusers 31. At least one diffuser 31 is provided within each room 20, 22, 24 and air lock 26. Each diffuser 31 has an individual damper (not shown) to regulate air flow through each diffuser 31 independently. Fresh air from diffusers 31 of ducts 30 is forced downward and toward the center of every room 20, 22, 24 and every air lock 26 of space 12 as shown by arrows 60.

The fresh air supplied to decontamination space 12 by decontamination space inlet ducts 30 may be obtained, for example, from the environment external to a building in which laminar air flow asbestos abatement system 10 is located, by way of a window (not shown), the air being forced into ducts 30 by a respective high velocity blower 29 within each duct 30.

Decontamination space outlet ducts 32 are positioned on the bottom of decontamination space 12 against opposing vertical walls 37 of decontamination space 12 directly below inlet ducts 30 to prevent buildup of particulate matter in the corners of space 12. As more particularly shown in FIG. 3, air supplied by decontamination space inlet ducts 30 is forced downwards and to the center of every room 20, 22, 24 and every air lock 26 of decontamination space 12 by way of inlet ducts 30. The air is then evacuated from every room 20, 22, 24 and air lock 26 by decontamination space outlet ducts 32 through evacuation registers 33 of ducts 32. Each register 33 is provided with a damper (not shown) for independent adjustment of the amount of air evacuated.

In the vicinity of sealable opening 39 duct outlet ports are provided for outlet ducts 32 through wall 36 of work space 14 to direct air evacuated from decontamination space 12 into work space 14. The outlet ports for ducts 32 most conveniently are positioned near the floor of work space 14 since ducts 32 extend along the floor of decontamination space 12. However, the air from ducts 32 may be ducted up to any height along first wall 36, and the ports in wall 36 for passage of air from ducts 32 may be positioned wherever necessary. A high velocity blower motor 35, within a portion of duct 32 extending into work space 14, forces evacuated air into work space 14.

Thus fresh air from the external environment is supplied to the top of each room 20, 22, 24 and air lock 26 in decontamination space 12, is withdrawn from each room 20, 22, 24 and air lock 26 in decontamination space 12, and is forced into work space 14 through duct outlets in first wall 36 of work space 14.

As shown in FIG. 1, wall 36 includes ports 38 to receive work space fresh air ducts 40. Fresh air supplied to work space 14 by way of work space fresh air ducts 40 may be obtained from the external environment, for example, from a window (not shown), as previously described for decontamination space inlet ducts 30. Fresh air from work space fresh air ducts 40 is forced outwardly away from first wall 36 into work space 14. Ports 38 for passage of ducts 40 are preferably located approximately midway between the top and bottom of wall 36.

Thus air is forced outwardly away from wall 36 of work space 14 by way of ducts 32 and ducts 40 spaced apart across the horizontal dimension of first wa11 36. Optimum particulate removal and minimum airborne particulate concentration is obtained if ducts 32, 40 are spaced apart approximately equidistant across the horizontal dimension of wall 36. The air which is forced away from wall 36 by ducts 32 and ducts 40 moves at a high velocity and advances across work space 14 from first wall 36 toward opposing second wall 42 of work space 14 in a substantially laminar fashion, thereby providing a first uniform air flow away from first wall 36. Therefore, asbestos removal work is normally begun closer to wall 36 and proceeds in the direction toward wall 42 to prevent recontamination of areas of work space 14 already cleaned.

Ducts 40 passing through first wall 36 of work space 14 may be provided with weighted induction dampers (not shown) to prevent backflow of air from work space 14 to the external environment. Work space 14 is kept at a negative pressure with respect to the environment in order to cause air to infiltrate into work space 14, as shown by arrows 50, rather than outwards, thus avoiding carrying contamination to the outside environment. A small negative pressure is sufficient for this purpose.

During a failure, positive pressure may develop within work space 14. This positive pressure could force air from work space 14 in the reverse direction out of work space 14 through ducts 40, carrying contaminants to the external environment. During such a period of positive pressure, weighted induction dampers within ducts 40 will close, preventing any air from flowing from work space 14 to the outside environment.

Furthermore, use of the weighted induction dampers, along with high velocity blowers 29,35 and independently controlled diffusers 31 and registers 33, permits independent control of the pressures and air flows of decontamination space 12 and work space 14. The optimum composition of air into work space 14 is believed to be about ten percent infiltration into workspace 14 as shown by arrows 50, twenty-five percent from decontamination space 12 by way of evacuation ducts 32, and the remainder outdoor air by way of ducts 40.

Normal to the direction of the first laminar flow of air away from first wall 36, there is positioned a first row of spaced apart, approximately equidistant air filtration devices 44 (FIG. 1). Air filtration devices 44, of a conventional design, receive air on the side of devices 44 facing the air flow and forceably expel air from the opposite side in a direction towards second wall 42 of work space 14. The received air is filtered within air filtration devices 44 before being expelled towards second wall 42. Thus, a first laminar flow of air proceeding in the direction from first wall 36 toward second wall 42 is drawn into air filtration devices 44, filtered, and then forced out in the same direction while maintaining a high flow rate to provide a second substantially laminar flow pattern. The upper parameters of the air inlet and air outlet of air filtration devices 44 are selected to be approximately midway between the floor and ceiling of work space 14.

The second substantially laminar air flow from the first row of air filtration devices 44 proceeds to a second row of air filtration devices 46 (FIG. 1). Air filtration devices 46 may be of the same design as air filtration devices 44. Air filtration devices 46 receive the second laminar flow on the side of air filtration devices 46 facing the flow as previously described for air filtration devices 44. Thus system 10 provides substantially end-to-end laminar flow through work space 14 to prevent regions of high particulate concentration and buildup of settled particles.

Air filtration devices 46 filter the received air within devices 46 and then exhaust the air by way of ducts 48 passing through ports 50 in wall 42. Air from ducts 48 may be exhausted to the external environment, for example, through a window (not shown). The upper parameters of the air inlets and air outlets of air filtration devices 46 are approximately midway between the floor and the ceiling of work space 14. The upper parameters of ports 50 for passage of ducts 48 through second wall 42 may be selected for convenience. Ducts 48 may be joined together to form a single duct (not shown) before passing through wall 42.

The air flow of air filtration devices 44, 46, is adjustable by rheostat. Air filtration devices 44,46 are selected to provide at least five thousand cubic feet per minute of flow through the high efficiency particulate filters within air filtration devices 44, 46. The number of air filtration devices 44, 46 is selected to provide a desired number of exchanges of the air within work space 14, for example, about 14 per hour. To determine the number of air filtration devices required for a given size work space 14, the number of cubic feet in work space 14 is multiplied by the number of cubic feet per minute of air that an air filtration device 44, 46 is rated to move. The number of exchanges per hour is then selected. Normally, it is desirable, in both the work and decontamination areas, to exchange with fresh air at least 12 times an hour although for some more dangerous substances up to 20 exchanges per hour is desirable.

By virtue of the system and method described above, the level of toxic particulates is reduced to safe levels both within a work area enclosed by a building and exterior of the building, and workers engaged in removal of the particulates as well as other persons in the vicinity of the removal operation are protected against contact in an efficient and economical manner.

Although the above description has been directed to the preferred embodiments of the invention, it will be understood and appreciated by those skilled in the art that other variations and modifications may be made without departing from the spirit and scope of the invention, and therefore the invention includes the full range of equivalents of the features and aspects set forth in the appended claims.

I claim:

1. A system for providing a safe work space within a building for removal of hazardous particulate materials therefrom, comprising:

a decontamination space comprising a plurality of enclosed decontamination rooms and air locks between the rooms;

a work space including opposing first and second walls, the work space communicating with the decontamination space through an opening in the first wall, the first work space wall having a fresh air duct therethrough;

means for supplying fresh air to the work space through the fresh air duct and forcing the fresh air outwardly away from the first wall;

at least two inlet ducts extending substantially the entire length of the decontamination space for supplying fresh air to each of the rooms and air locks;

at least two outlet ducts extending substantially the entire length of the decontamination space and spaced apart from the inlet ducts for evacuating air from each of the rooms and air locks, said outlet ducts extending through outlet duct openings in the first wall;

means for forcing evacuated air through the outlet duct openings and outwardly away from the first wall whereby said evacuated air and the fresh air from said fresh air duct act cooperatively to form a first substantially uniform air flow away from the said first wall;

a plurality of first spaced apart air filtration devices positioned in a first row normal to the first uniform air flow and approximately midway between the first and second walls of the work space for filtering the first uniform air flow and expelling the resulting filtered air from the plurality of first air filtration devices to form a second substantially unform air flow away from the first row;

a plurality of second spaced apart air filtration devices positioned proximate to the second wall in a second row normal to the second uniform air flow for filtering the second uniform air flow; and exhaust ducts coupled to the air filtration devices of the second row for exhausting to the external environment air from the second row of filtration devices.

2. The system of claim 1 wherein each inlet duct includes a diffuser in each of the rooms and air locks.

3. The system of claim 1 wherein each outlet duct includes a register in each of the rooms and air locks.

4. The system of claim 1 wherein the exhaust ducts include means for exhausting air from the second row of air filtration devices outside the building.

5. The system of claim 1 further comprising means for independently controlling the pressure of the decontamination space and the pressure of the work space.

6. The system of claim 1 wherein the decontamination space has opposing vertical walls and each inlet duct is disposed at the top of one of the vertical decontamination space walls.

7. The system of claim 6 wherein each of the outlet ducts is disposed at the bottom of one of the vertical decontamination space walls.

8. The system of claim 6 wherein said walls are formed of plastic sheets.

9. The system of claim 6 wherein the walls comprise temporary walls.

10. The system of claim 1 wherein the first work space wall is provided with a plurality of fresh air ducts.

11. The system of claim 10 wherein the means for supplying fresh air includes means for supplying fresh air from outside the building.

12. The system of claim 1 wherein said decontamination space includes a flap-seal doorway between each adjacent room and air lock.

13. The system of claim 12 wherein the dimensions of the air locks are sufficient to permit a user to completely close a first flap-seal doorway of an air lock before opening a second flap-seal doorlock of said air lock.

14. A method of providing a safe work space within a building for removal of hazardous particulate materials therefrom, comprising (1) defining a decontamination space comprising a plurality of enclosed decontamination rooms and air locks between the rooms;

(2) defining a work space including opposing first and second walls, the work space communicating with the decontamination space through an opening in the first wall, the first wall having a fresh air duct therethrough;

(3) supplying fresh air to the work space through the fresh air duct and forcing the fresh air outwardly away from the first wall;

(4) supplying fresh air to each of the rooms and air locks through at least two inlet ducts extending substantially the entire length of the decontamination space;

(5) evacuating air from each of the rooms and air locks through at least two outlet ducts extending substantially the entire length of the decontamination space and spaced apart from the inlet ducts, said outlet ducts extending through outlet duct openings in the first wall;

(6) forcing said evacuated air through the outlet duct openings and outwardly away from the first wall whereby said evacuated air and the fresh air from said fresh air duct act cooperatively to form a first substantially uniform air flow away from the first wall;

(7) first filtering the air of the first uniform air flow by a plurality of first spaced apart air filtration devices positioned in a first row normal to the first uniform air flow and approximately midway between the first and second walls of the work space and expelling the resulting filtered air from the plurality of first air filtration devices to form a second substantially uniform air flow away from the first row;

(8) second filtering the air of the first uniform air flow by a plurality of second spaced apart air filtration devices positioned proximate to the second wall in a second row normal to the second uniform air flow; and (9) exhausting to the external environment air from the second row of filtration devices through exhaust ducts from each of the air filtration devices of the second row.

15. The method of claim 14 wherein a plurality of fresh air ducts is positioned in said first wall, and further including the step of supplying fresh air from outside the building through each duct of the plurality of fresh air ducts.

16. The method of claim 14 wherein the step of exhausting to the external environment air from the second row of air filtration devices comprises exhausting the air to the exterior of the building.

17. The method of claim 14 wherein a flap-seal doorway is provided between each adjacent room and air lock.

18. The method of claim 14 wherein the decontamination space has opposing vertical walls, and each of the inlet ducts is positioned at the top of one of the vertical decontamination space walls.

19. The method of claim 18 wherein each of the outlet ducts is disposed at the bottom of one of the vertical decontamination space walls.

20. The method of claim 18 wherein the walls of the decontamination space and work space comprise temporary walls of plastic sheets.

21. The method of claim 20 wherein the plastic sheets define air locks of sufficient dimensions to permit a user to completely close a first flap-seal of an air lock before opening a second flap-seal of the air lock.

* * * * *